US005187917A

United States Patent [19]

Mykleby

[11] Patent Number: 5,187,917

[45] Date of Patent: Feb. 23, 1993

[54] AUTOMATIC PACKAGING APPARATUS AND METHOD AND FLEXIBLE POUCH THEREFOR

[75] Inventor: Laurie G. Mykleby, Palos Park, Ill.

[73] Assignee: CVP Systems, Inc., Downers Grove, Ill.

[21] Appl. No.: 762,330

[22] Filed: Sep. 18, 1991

Related U.S. Application Data

[63] Continuation-in-part of Ser. No. 605,038, Oct. 29, 1990, abandoned.

[51] Int. Cl.[5] ..... B65B 31/06

[52] U.S. Cl. ..... 53/434; 53/512; 53/568

[58] Field of Search ..... 225/104, 105; 53/433, 53/434, 510, 511, 512, 562, 568

[56] References Cited

U.S. PATENT DOCUMENTS

| | | | |
|---|---|---|---|
| 2,281,187 | 4/1942 | Waters . | |
| 2,410,834 | 11/1946 | Messmer . | |
| 2,753,671 | 7/1956 | De Puy et al. . | |
| 2,863,267 | 12/1958 | Moore . | |
| 2,902,197 | 9/1959 | Potdevin et al. | 225/105 |
| 3,359,703 | 12/1967 | Quaadgras . | |
| 3,430,414 | 3/1969 | Ludwig et al. . | |
| 3,650,461 | 3/1972 | Hutcheson . | |
| 3,688,463 | 9/1972 | Titchenal . | |
| 3,699,746 | 10/1972 | Titchenal et al. . | |
| 3,751,875 | 8/1973 | Membrino . | |
| 3,863,821 | 2/1975 | Van Bennekom | 225/105 X |
| 3,941,306 | 3/1976 | Weikert . | |
| 4,021,283 | 5/1977 | Weikert . | |
| 4,514,962 | 5/1985 | Ausnit | 53/568 X |
| 4,730,439 | 3/1988 | Chung et al. . | |
| 4,945,714 | 8/1990 | Bodolay et al. | 53/562 X |
| 4,946,086 | 8/1990 | Suuronen et al. | 225/105 X |
| 4,969,310 | 11/1990 | Lerner et al. . | |

FOREIGN PATENT DOCUMENTS

| | | |
|---|---|---|
| 537917 | 5/1955 | Belgium . |
| 2145774 | 2/1973 | France . |

*Primary Examiner*—John Sipos
*Assistant Examiner*—Daniel B. Moon
*Attorney, Agent, or Firm*—Speckman & Pauley

[57] ABSTRACT

An automatic packaging apparatus having a conveyor belt and a plurality of flexible pouches forming a continuous sheet of web material. Each flexible pouch has an open end and an overlap portion specifically suitable for operation with the apparatus of this invention. The open end is separated and a load is inserted into a first active pouch of the flexible pouches. After the load is inserted into the flexible pouch, air is withdrawn from the flexible pouch. Air is withdrawn from the flexible pouch and a gas is preferably injected into the flexible pouch. The flexible pouch is then heat sealed to form a gas-tight seal. Controls are used to simultaneously operate the sealing, fluid transfer and loading stations of the automatic packaging apparatus. As the flexible pouch moves from the fluid transfer station to the sealing station, the gas-tight seal is maintained.

16 Claims, 7 Drawing Sheets

AUTOMATIC PACKAGING APPARATUS AND METHOD AND FLEXIBLE POUCH THEREFOR

CROSS-REFERENCE TO RELATED APPLICATION

This application is an continuation-in-part of copending U.S. patent application Ser. No. 07/605,038, filed Oct. 29, 1990, abandoned.

BACKGROUND OF THE INVENTION

1. Field of the Invention

This invention relates to an apparatus and method for automatic packaging, particularly for modified atmosphere packaging, in which a load of poultry, produce or the like is inserted into a plastic bag, air is drawn out of the bag and a gas is injected into the bag, and then the plastic bag is heat sealed to form a gas-tight seal. This invention also relates to the particular plastic bag or flexible pouch associated with the apparatus and method for automatic packaging.

2. Description of Prior Art

Conventional apparatuses exist for feeding plastic sheets or plastic bags over a conveyor belt. Conventional apparatuses also exist for heat sealing plastic bags. However, when a probe or snorkel is inserted into a plastic bag and then withdrawn, in conventional apparatuses, the plastic bag has a tendency to lose pressure, particularly vacuum pressures, in the process of advancing to a heat sealing station since the two webs of the plastic bag cannot be held together as the plastic bag is transferred from a fluid transfer station to a heat sealing station.

In conventional apparatuses, a plastic bag is typically held in one position while it is loaded, a probe or snorkel is inserted into the bag to draw a vacuum in the bag, the probe or snorkel is extracted, and the bag is heat sealed. In order to reduce the amount of time and labor necessary to vacuum package products, an automatic packaging apparatus and method are needed in which a plastic bag is transferred from one position to a downline position for the loading, fluid transfer and heat sealing steps.

U.S. Pat. No. 3,359,703 discloses an apparatus for making and filling a series of bags. A series of bags are fed by driven belts, the drive of which stops when the bag reaches a filling device. A narrow wedge is placed behind a separating element for opening each bag at its upper edge. Behind the wedge, a tube which is connected to an air supply source is used to blow air into the bag and thus open the bag. Simultaneously, a subatmospheric pressure is applied to a pair of suction pads on both sides of the film of the bag, under the filling device, so that the walls of the bag are sucked against such pads. The suction pads move outwards, so that the bag is rapidly opened. Once the filling of the bag begins, the air supply and the vacuum in the suction pads are interrupted. The '703 patent neither teaches nor suggests either a snorkel or probe for injecting a gas into or drawing a gas from the plastic bag or means for maintaining a gas-tight seal upon the bag as it is transferred from such fluid transfer station to a heat sealing station.

U.S. Pat. No. 2,281,187 teaches a machine and method for packing commodities into individual and non-continuous plastic bags. A spout is inserted into a mouth of a bag which is positioned immediately beneath the spout in order to apply suction and draw a fluid from the bag. An inert gas is then injected into the bag.

The '187 neither teaches nor suggests either a continuous sheet having a plurality of plastic bags or maintaining a gas-tight seal on the bag as it is automatically transferred from a gas transfer station to a heat sealing station.

U.S. Pat. No. 3,430,414 discloses a machine for packaging articles in a controlled atmosphere. A resilient sealing pad is secured to a front carrier to travel with the bags along their paths, at a sealing station. The carriers are two endless chains positioned side-by-side in a common, horizontal plane. The chains are driven at the same speed as a bag carrier to move the pads at the speed of the bags. The '414 patent also teaches individual and non-continuous plastic bags which are filled and then moved to a fluid transfer station. The '414 patent does not disclose maintaining a gas-tight seal on the plastic bags as they are transferred from a gas transfer station to a heat sealing station.

U.S. Pat. No. 3,688,463 relates to a vacuum packaging system wherein flaps are plowed open to assist in automatically filling the bags without need for probes, spreaders or the like to open the bags for evacuation purposes. U.S. Pat. No. 2,863,267 teaches an air extractor and sealing device used to extract air from commodity packed containers and hermetically sealing such packed containers. U.S. Pat. No. 2,410,834 teaches a machine for sealing bags after air has been removed from the bags. V-shaped belts are used to transport the bags from air removing means to bag sealing means.

U.S. Pat. No. 2,753,671 discloses a machine for vacuum packaging foods or commodities in flexible sheet material of a type which can be heat sealed. The machine has different working stations at which operations are simultaneously performed on a series of packages, so that one or more units can be worked on at each station at all times during settled operation of the machine.

U.S. Pat. No. 4,969,310 teaches a packaging machine and method for loading bags which are interconnected at the side of the bags. The '310 patent teaches an articulated arm for rupturing interconnections of the bags.

U.S. Pat. No. 4,730,439 teaches a method and apparatus for packaging a product in individual vacuum sealed packets. A sheet of flexible packaging material is formed into a channel-shaped member having spaced apart vertical side walls. A predetermined amount of flowable product is introduced into each of the open top packets. The upper corner portions of each individual packet are sealed to reduce the size of the opening in the packets. A vacuum tube is introduced into the open top packet and the upper portion of the open top packet is sealed around the vacuum tube. The vacuum tube is then retracted and a final horizontal top seal is produced above the initial top seal.

U.S. Pat. No. 4,021,283 teaches a method of making aseptic packaging which is free of pathogenic microorganisms. The bags are filled with a sterile product and sealed without exposing the contents of the bags to ambient air which would destroy the sterile interiors of the bags.

U.S. Pat. No. 3,751,875 discloses an apparatus having two sprocket wheels for advancing a strip of interconnected bags that are filled, sealed and dispensed. The strip of bags has spaced sprocket apertures in an edge portion of the strip. The apertures are engaged by sprockets on the sprocket wheel to linearly move the strip of bags.

SUMMARY OF THE INVENTION

It is one object of this invention to provide an automatic packaging apparatus in which a vacuum seal is maintained in a plastic bag as the plastic bag and contents are conveyed from one position to a downline position.

It is another object of this invention to provide a continuous sheet of flexible material that forms a plurality of interconnected flexible pouches specifically suitable for use with the apparatus and method of this invention.

It is yet another object of this invention to provide an automatic packaging apparatus which feeds a continuous sheet of film material to the loading, fluid transfer and sealing stations.

According to one preferred embodiment of this invention, the above objects are accomplished with an automatic packaging apparatus having driven transfer V-belts. A continuous sheet forming a plurality of flexible pouches is fed into the V-belts. Each flexible pouch has an open end at an upper portion. Each flexible pouch also has an overlap portion which acts as a shield to prevent grease, water, and other contaminant materials from contacting the V-belts.

A loading station is positioned downline with respect to the feed for the continuous sheet. At the loading station, the open end of a corresponding flexible pouch is separated and a load is inserted into the flexible pouch. The flexible pouch is then transported to a fluid transfer station which is positioned downline with respect to the loading station. A snorkel is inserted into the corresponding flexible pouch. With the snorkel, a vacuum pressure supply is preferably used to remove the air from the bag and a positive pressure supply is preferably used to inject a gas, such as a preservative gas, into the corresponding flexible pouch.

The flexible pouch is then transported by the V-belts to a sealing station where the open end of each flexible pouch is sealed to form a gas-tight seal. The feed of the continuous sheet is controlled so that corresponding flexible pouches are simultaneously positioned at the loading station, the fluid transfer station and the sealing station.

It is an important aspect of this invention for the transfer V-belts to be positioned on both sides of the continuous sheet, so that the transfer V-belts can be compressed against each other and thus maintain the gas-tight seal until each flexible pouch is conveyed or transported from the fluid transfer station to the sealing station. The transfer V-belt is continuously routed through the loading station, the fluid transfer station and the sealing station.

According to another preferred embodiment of this invention, the above objects are accomplished with an automatic packaging apparatus having a horizontal conveyor belt upon which a continuous sheet of film or web material, preferably plastic, is fed. A plurality of flexible pouches or bags form the continuous sheet of film or web material. Each pouch has an open end for inserting a load.

The open end of the pouch is spread apart and the load is inserted into the pouch. As the flexible pouch moves from the loading station to a fluid transfer station, a probe or snorkel is inserted into the flexible pouch. The snorkel is used to withdraw the air from the pouch and preferably create a vacuum within the pouch. The snorkel is then used to transfer fluid, preferably a preservative gas or the like, into the flexible pouch.

Once the flexible pouch is moved to the sealing station, the open end of the pouch is heat sealed to form a gas-tight seal. As the flexible pouch moves from the fluid transfer station to the sealing station, the gas-tight seal is maintained by driven V-belts compressing the web material on both sides of the flexible pouch.

With such automatic packaging apparatus of this invention, the loading, fluid transfer and sealing steps are simultaneously performed.

The specific design of the flexible pouch or plastic bag is an important aspect of this invention. The flexible pouch must be compatible with the mechanical elements of the apparatus. In one preferred embodiment according to this invention, the flexible pouch comprises two webs formed from a film of flexible material. A plurality of interconnected flexible pouches are preferably stored in a rolled form. Both webs of each flexible pouch are preferably heat sealed along their sides. The side heat seals preferably extend from a bottom edge of the flexible pouch to a fixed distance from the top edge of the pouch thereby forming an overlap portion. The continuous sheet of interconnected flexible pouches has perforations between the side heat seals of adjacent flexible pouches. In one preferred embodiment of this invention, each perforation has an upper perforated portion which has a higher tearing strength than a lower perforated portion.

BRIEF DESCRIPTION OF THE DRAWINGS

The above mentioned and other features of this invention and the manner of obtaining them will become more apparent, and the invention itself will be best understood by reference to the following description of specific embodiments taken in conjunction with the drawings, wherein.

DESCRIPTION OF PREFERRED EMBODIMENTS

The automatic packaging apparatus of this invention is used to package meats, poultry, produce and other perishable goods in plastic bags. The plastic bags preferably have a modified atmosphere which is achieved by extracting the air from the bag and injecting a gas, preferably containing preservatives, into the bag.

Figures 1, 1A:
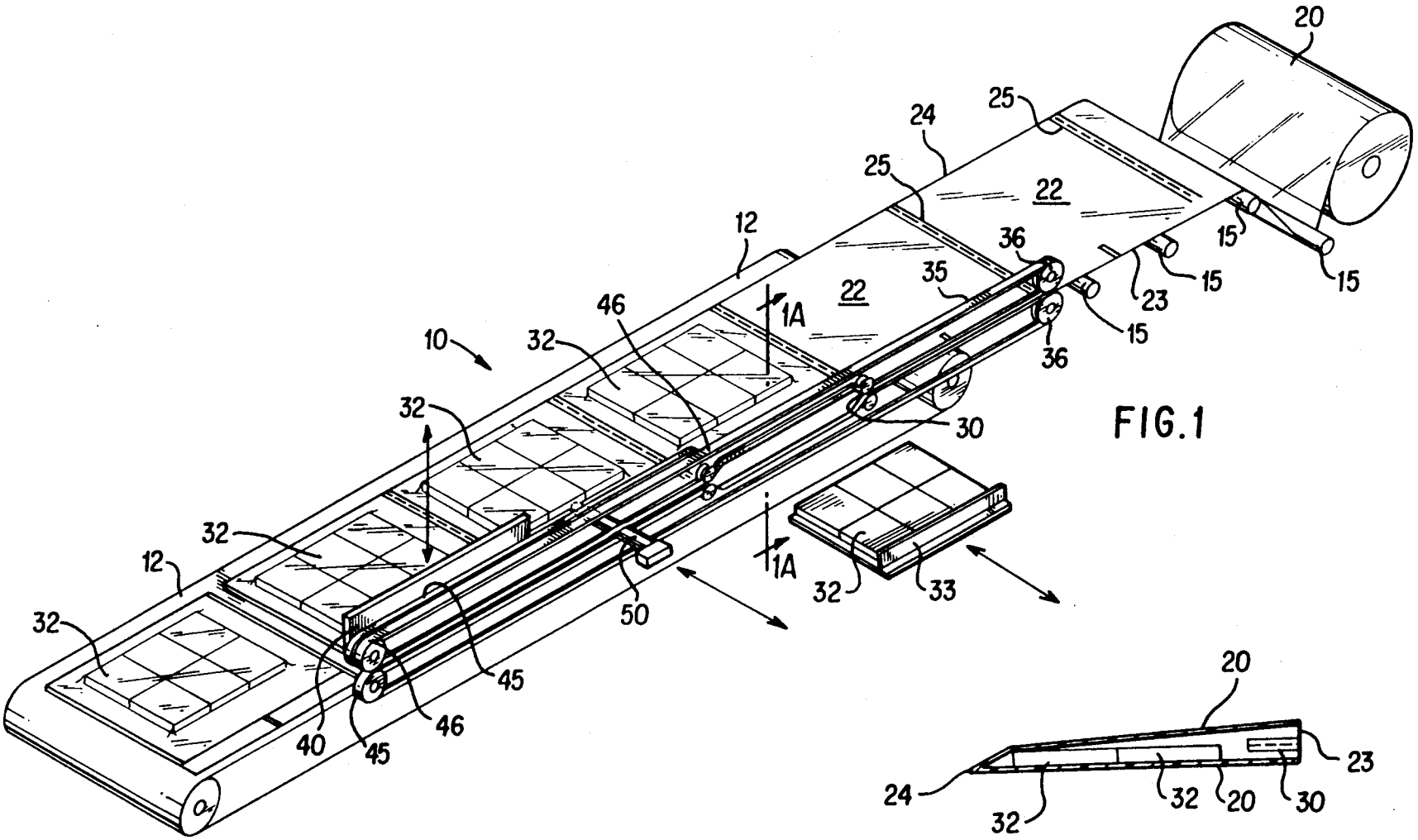
FIG. 1 is a perspective view of the main components of the automatic packaging apparatus according to this invention.
FIG. 1A is a cross-sectional view along line 1A—1A, as shown in FIG. 1, which shows a load positioned within webs of the flexible pouch, according to the embodiment as shown in FIG. 1.
Figure 2:
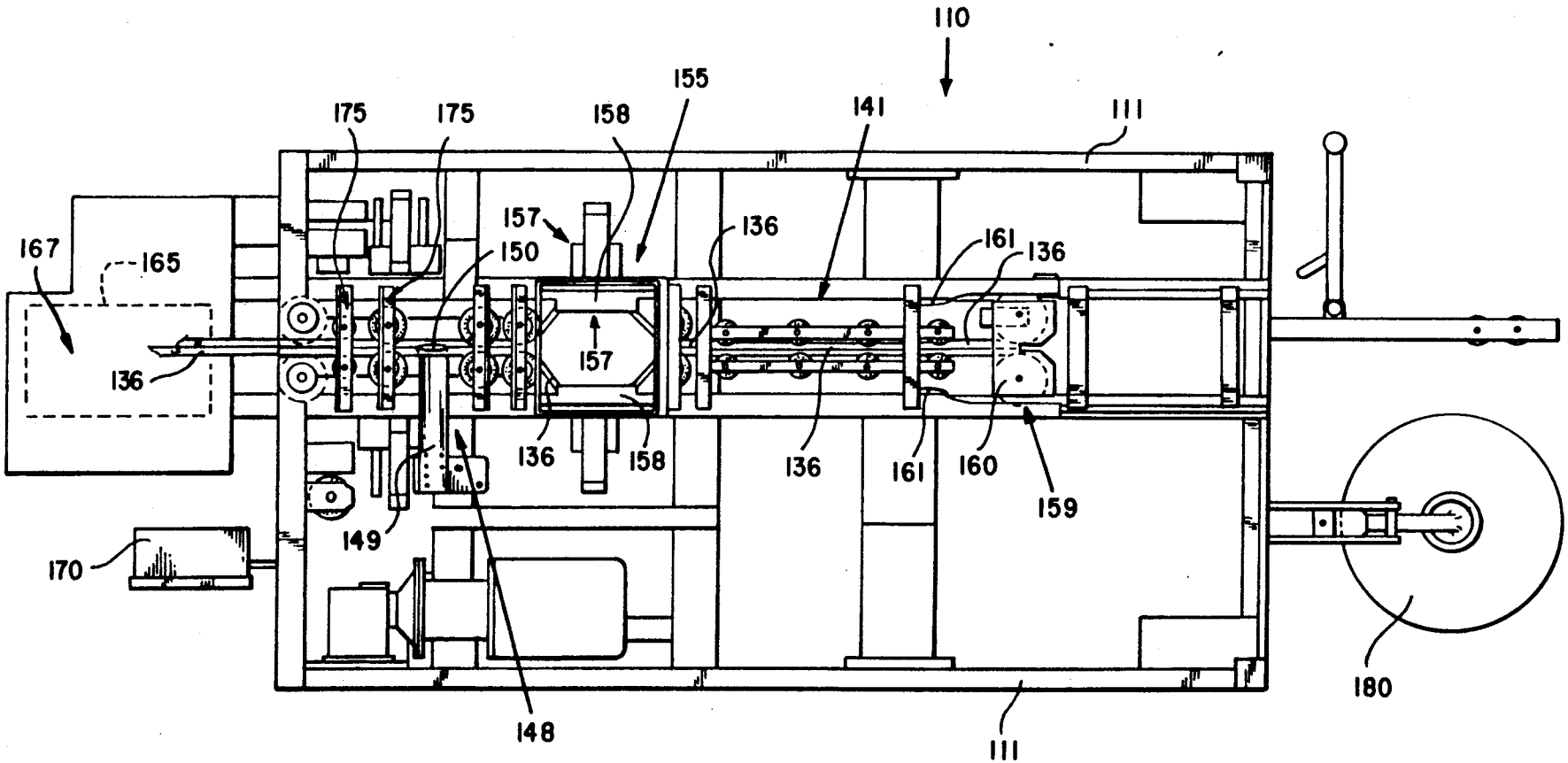
FIG. 2 is a plan view of an automatic packaging apparatus according to one preferred embodiment of this invention.

Referring to FIG. 1, the overall arrangement of automatic packaging apparatus 10 is preferably in a horizontal position. However, it is apparent that automatic packaging apparatus 10 can operate in a vertical position as shown in FIG. 2 or in any other suitable position. Conveyor belt 12 is driven and operated by any conventional means known within the art. Web material 20 is shown in rolled form but can also be in stacked, layered form, or in any other suitable form. Web material 20 is preferably routed over web guides 15. According to the preferred embodiment as shown in FIG. 1, feed V-belts 35 and V-belt drives 36 are used to feed web material 20 through automatic packaging apparatus 10. However, it is apparent that depending upon the particular arrangement, more than one V-belt can be used.

Web material 20 preferably comprises a plurality of flexible pouches or bags 22. In one preferred embodiment according to this invention, flexible pouch 22 has sealed end 24 and sealed sides 25, as shown in FIG. 1. Sealed end 24 and sealed sides 25 are preferably heat sealed since flexible pouch 22 is preferably constructed of plastic material. It is apparent that sealed end 24 can be sealed by folding web material 20 rather than by heat sealing. Flexible pouches 22 are preferably perforated along the dashed lines as shown in FIG. 1. It is an important aspect of this invention that the heat seals along sealed sides 25 do not extend all the way to the top edge or to open end 23 of flexible pouch 22. Stopping the heat seal at a defined distance from the top edge of flexible pouch 22 at open end 23 allows feed means to feed the continuous sheet on and along conveyor belt 12. As further discussed below, V-belts are preferably used to maintain a gas-tight seal with respect to each pouch that conveyor belt 12 moves in a downline direction from fluid transfer means to sealing means. Thus, the heat seal along sealed sides 25 must extend toward and at least as far as the V-belts.

Loading means are used to separate open end 23 and insert a load into a first active flexible pouch 22. The term "active" as used throughout this specification and in the claims is intended to relate to a flexible pouch 22 that is subjected to either a loading station, a fluid transfer station, or a sealing station of the packaging process according to this invention. As shown in FIG. 1, the loading means comprise tray 33 for inserting load 32 into the first active flexible pouch 22. Tray 33 moves in a direction in and out of the pouch, as shown by the corresponding arrow in FIG. 1. In one preferred embodiment of this invention, the loading means comprise separator 30, which is shown in FIG. 1A as having a triangular cross section.

According to the embodiment shown in FIG. 1, once the first active flexible pouch 22 is supplied with a load, control means are used to move conveyor belt 12 in a downline direction. The first active flexible pouch 22 is then moved to a fluid transfer station where fluid transfer means are used to draw a fluid, preferably air from the first active flexible pouch 22. The fluid transfer means are then used to inject a fluid, preferably a gas, into the first active flexible pouch 22. As shown in FIG. 1, the fluid transfer means comprise snorkel or probe 50 in communication with a positive pressure pump, a compressor or a vacuum pump. It is apparent that other suitable fluid transfer devices can be used to inject and draw gases from flexible pouch 22. Snorkel 50 preferably moves into and out of flexible pouch 22 in a direction along the corresponding arrow, as shown in FIG. 1.

The first active flexible pouch 22 is then moved downline by conveyor belt 12 to a sealing station where open end 23 is sealed, preferably heat sealed with heat seal bar 40, to form a gas-tight seal within flexible pouch 22. Web transfer means are used to maintain a gas-tight seal with respect to each flexible pouch 22 that conveyor belt 12 transports from the fluid transfer means to the sealing means. The control means are used to simultaneously operate the sealing means with respect to the first active pouch 22, the fluid transfer means with respect to a second active pouch 22, and the loading means with respect to a third active pouch 22. Such control means are known to those skilled in the art.

It is an important aspect of this invention for the web transfer means to maintain the gas-tight seal as flexible pouch 22 is moved from the fluid transfer station to the sealing station. According to the preferred embodiment shown in FIG. 1, such aspect of this invention is accomplished with seal V-belts 45 which are driven by V-belt drive 46. Seal V-belts 45 are positioned on each side of flexible pouch 22 so that the V-belts compress both webs of plastic material together to prevent any leakage. It is apparent that seal V-belt 45 can be replaced with any other suitable belt or other device which compresses the plastic webs. It is also apparent that depending upon the working environment within flexible pouches 22 and other design parameters, seal V-belts 45 may not be necessary if feed V-belts 35 accomplish adequate results.

Another preferred embodiment according to this invention is shown in the plan view of FIG. 2. Automatic packaging apparatus 110, as shown in FIG. 2, operates with flexible pouches 122 in a vertical position and thus does not require a horizontal conveyor belt. In such preferred embodiment, transfer V-belts 136 are routed through belt tensioning means 159, film separating means 141, loading station 155, fluid transfer station 148, compression means 175, and finally, sealing station 165. The preferred embodiment as shown in FIG. 2 uses only two transfer V-belts 136. It is apparent that depending upon the arrangement of the pulleys and the frame, one or more than two transfer V-belts 136 can also be used to accomplish the same result of transporting flexible pouches 122 from station to station.

Figure 6A:
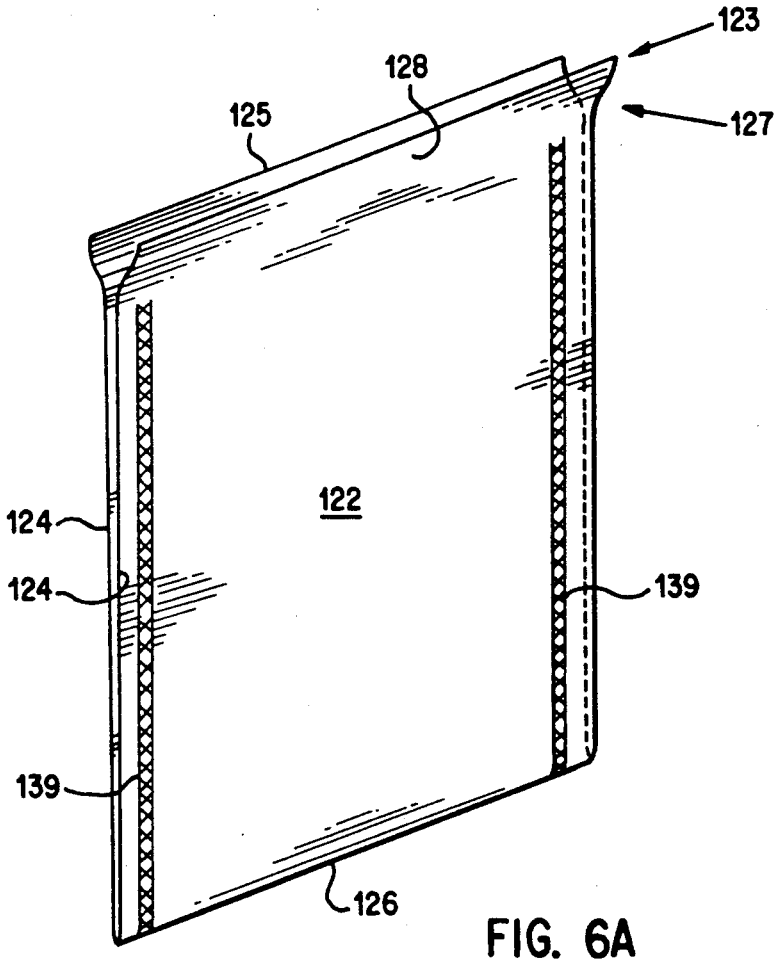
FIG. 6A is a front view of a flexible pouch according to another preferred embodiment of this invention.

A continuous sheet of flexible material forming a plurality of interconnected flexible pouches 122 is preferably stored in a rolled form. However, it is apparent that the continuous sheet of flexible pouches 122 can also be stored in a stacked, layered form or in any other suitable form. The phrase "continuous sheet" as used throughout this specification and in the claims is intended to relate to a fixed set of flexible pouches 122 that are interconnected at their sides. It is apparent that the continuous sheet is not an endless sheet and must be replaced when the fixed quantity of flexible pouches 122 is depleted for each continuous sheet. Each flexible pouch 122 preferably has open end 123 at upper portion 127 of flexible pouch 122, as shown in FIG. 6A.

Figure 4A:
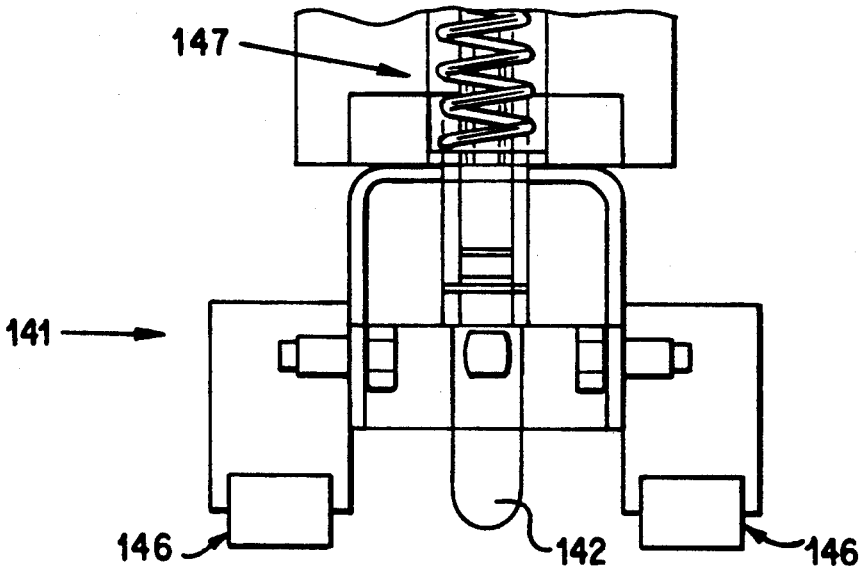
FIG. 4 is a top view of a film separator bar assembly according to one preferred embodiment of this invention.
FIG. 4B is a top view of a breaker backup bracket assembly according to one preferred embodiment of this invention.
Figure 4B:
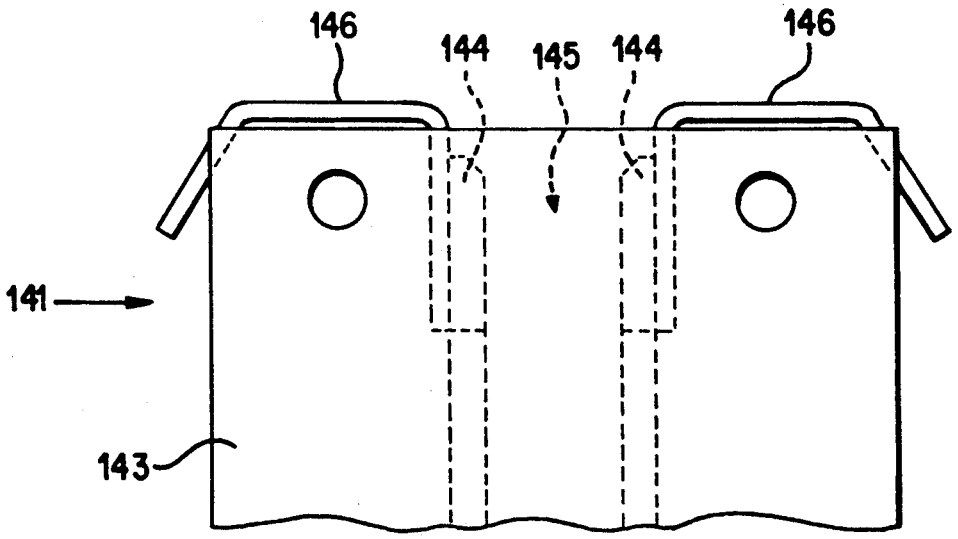
Figure 5:
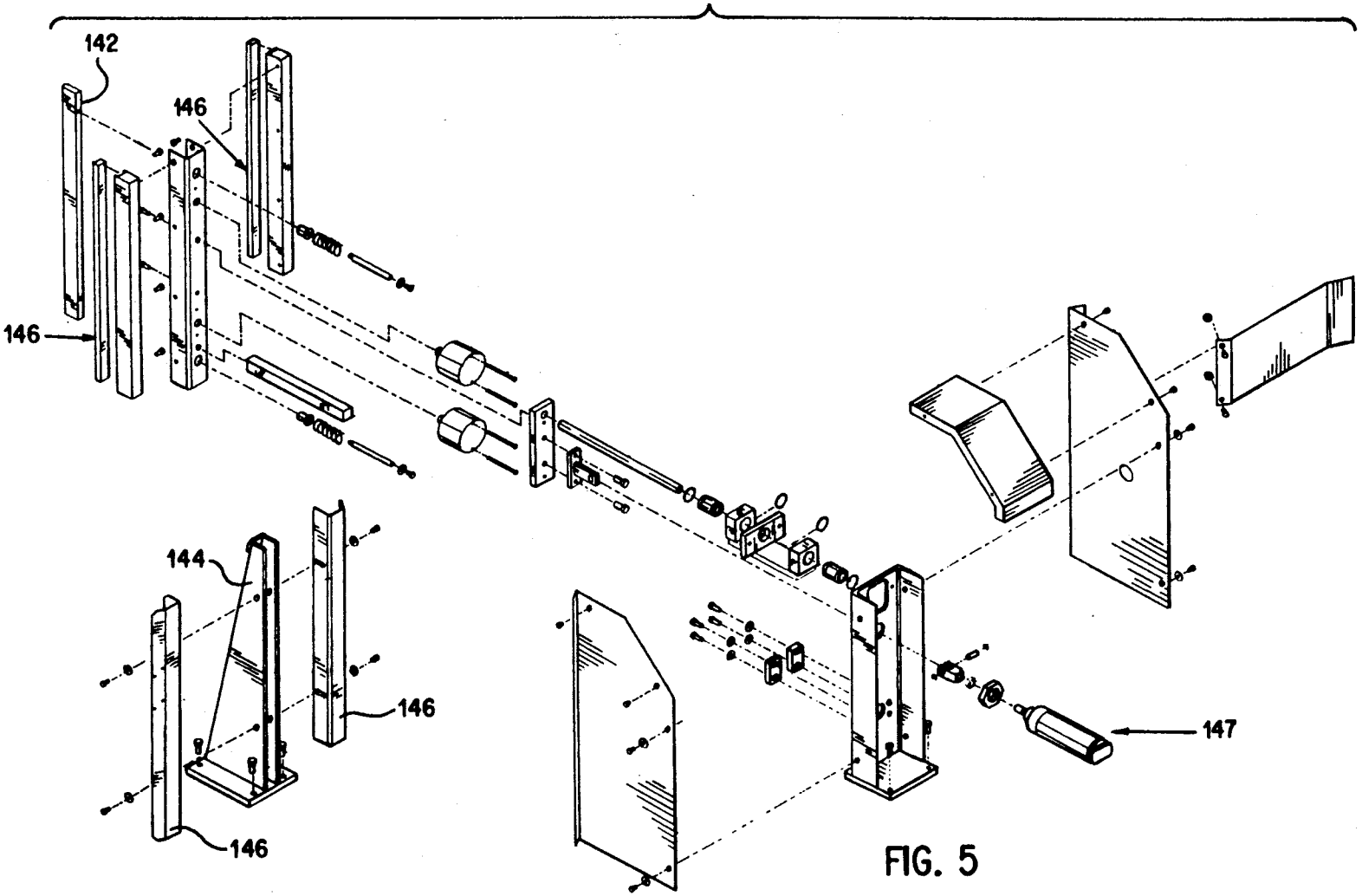
FIG. 5 is an exploded perspective view of the film separator bar assembly and the breaker backup bracket assembly according to one preferred embodiment of this invention.

According to one preferred embodiment of this invention, automatic packaging apparatus 110 has film separating means 141 positioned in the general location shown in FIG. 2. Although FIG. 2 does not show film separating means 141 in detail, FIGS. 4A, 4B and 5 illustrate the basic elements of film separating means 141. Film separating means 141 is used to separate flexible pouches 122 from the continuous sheet.

Figure 6:
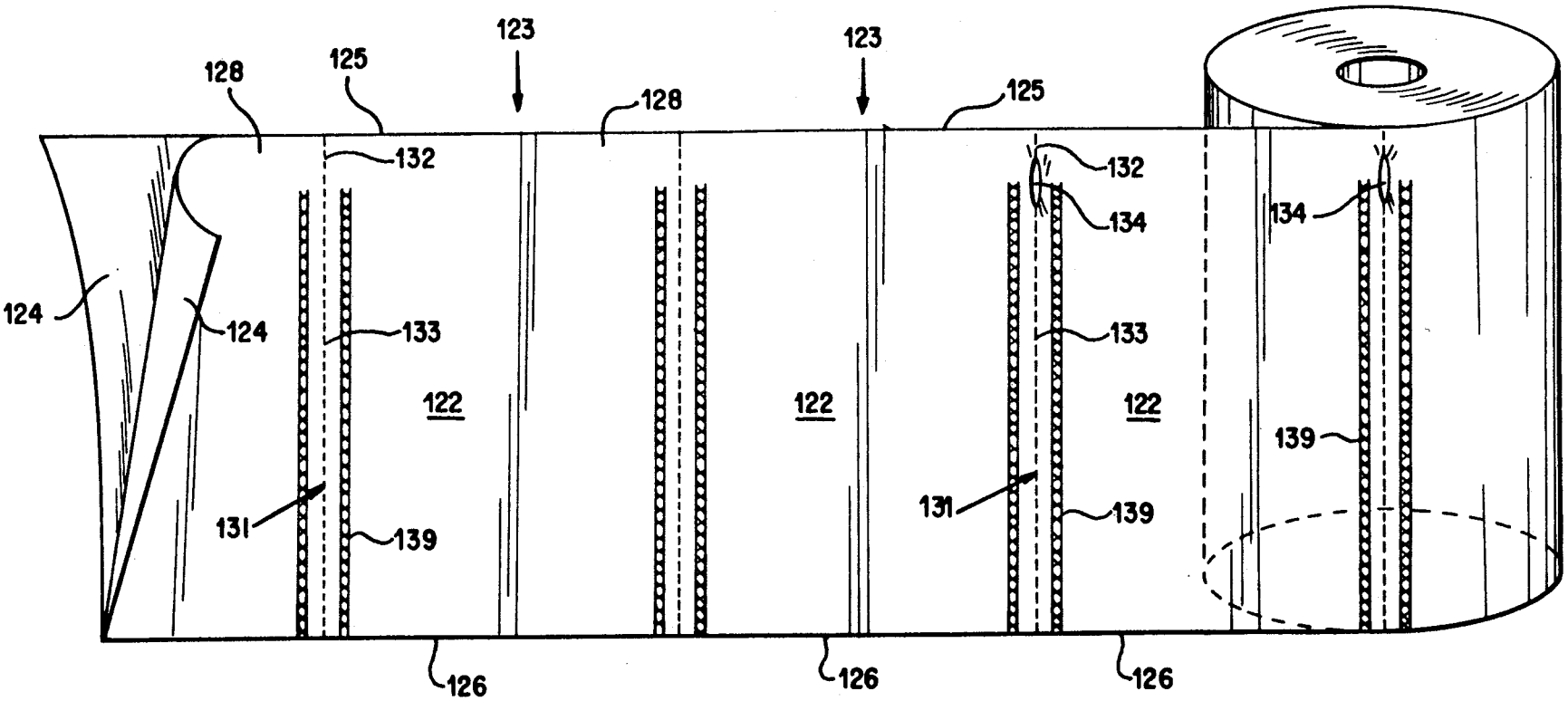
FIG. 6 is a front view of a continuous sheet forming a plurality of flexible pouches according to one preferred embodiment of this invention.

As shown in FIGS. 4A and 4B, film separator bar 142 is shown in a top view. In the vertical view, film separator bar 142 is elongated, as shown in FIG. 5. Breaker backup bracket 143 has vertical sides 144 that define breaker space 145, which is mateable with film separator bar 142. Gripping means 146 are used to secure adjacent flexible pouches 122 with respect to each other as film separating means 141 separates at least a portion of perforation 131, as shown in FIG. 6, between each adjacent pair of flexible pouches 122. As shown in FIGS. 4A and 4B, gripping means 146 comprise brackets mounted on breaker backup bracket 143 which contact rubber pads or the like mounted on the frame supporting film separator bar 142. As the continuous sheet is moved between film separator bar 142 and breaker backup bracket 143, actuating means 147 displaces film separator bar 142 into a mated position with respect to breaker space 145. Before film separator bar 142 contacts the continuous sheet at the line of perforation 131, gripping means 146 contact and hold adjacent flexible pouches 122 so that as film separator bar 142 continues to move within breaker space 145, flexible pouches 122 remain secure and allow perforation 131 to separate. According to another preferred embodiment of this invention, film separator bar 142 has dimensions which are appropriate for separating only lower perforated portion 133, as shown in FIG. 6, of the overall perforation 131. Such embodiment is advantageous since upper perforated portion 132 can remain intact as the continuous sheet is transported through the different stations of automatic packaging apparatus 110.

It is apparent that film separating means 141 can be positioned at other areas with respect to frame 111, depending upon which area is most advantageous to break perforation 131 between flexible pouches 122. As shown in FIG. 2, film separating means 141 is advantageously positioned since such particular portion of frame 111 is not occupied with other complex components.

As shown in FIG. 2, loading station 155 is positioned downline with respect to the feed means for the continuous sheet of flexible pouches 122. Loading means 157, which are preferably positioned at loading station 155, are used to separate open end 123 of flexible pouch 122. Loading means 157 are also used to insert a load, such as poultry, meat, ice, produce or the like, into each flexible pouch 122 at loading station 155.

As shown in FIG. 2, loading means 157 comprises actuated spreader brackets 158 for separating flexible pouch 122. Transfer V-belt 136 is routed behind each spreader bracket 158. Conventional loading means 157 are known to those skilled in the art.

Fluid transfer station 148 is positioned downline with respect to loading station 155. Fluid transfer means 149 is positioned at fluid transfer station 148. Fluid transfer means 149 is used to selectively inject or withdraw fluids, preferably gases, into and from each flexible pouch 122 at fluid transfer station 148.

Figure 3A:
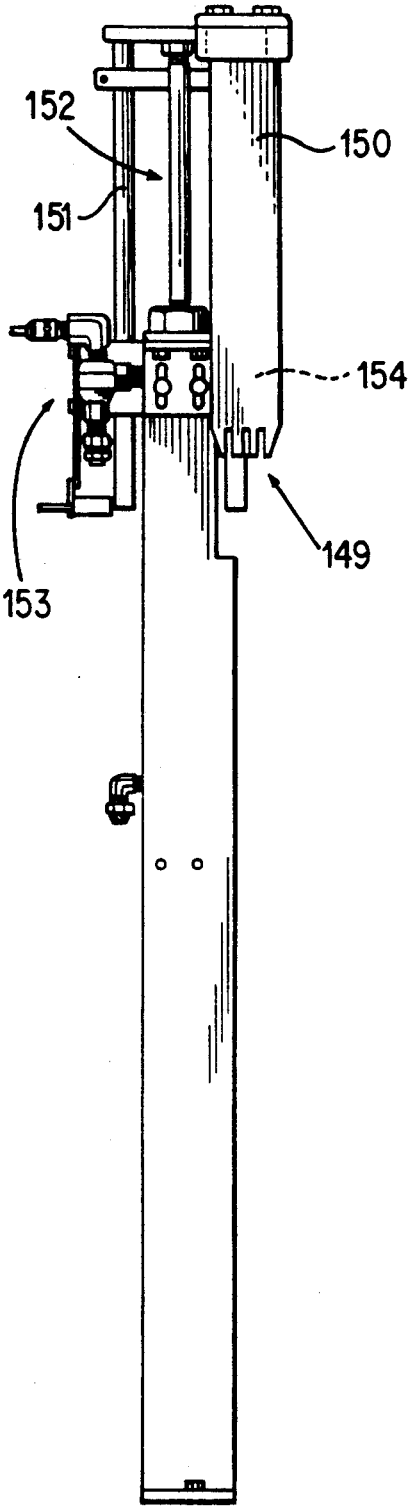
FIG. 3A is a front view of a snorkel assembly according to one preferred embodiment of this invention.
Figure 3B:
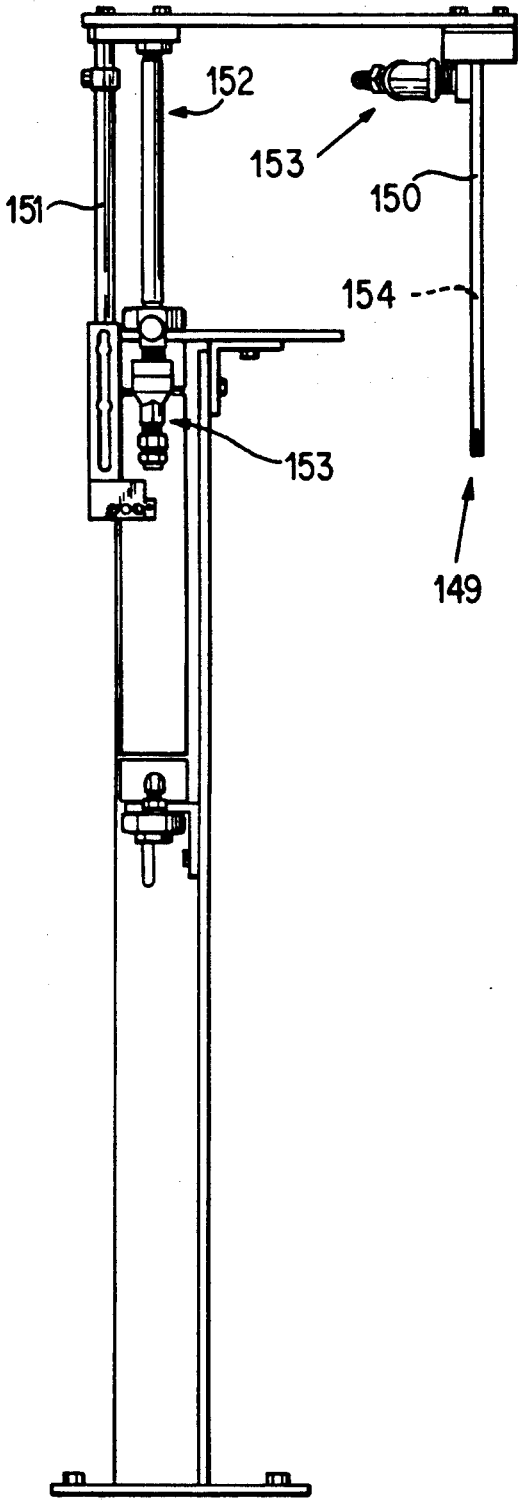
FIG. 3B is a side view of the snorkel assembly as shown in FIG. 3A.
Figure 3C:
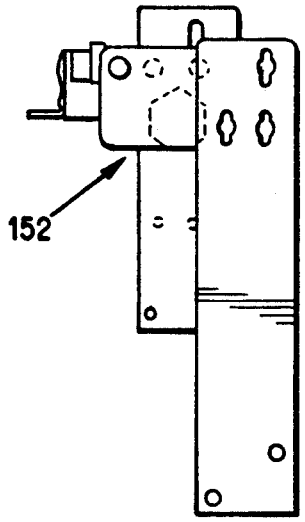
FIG. 3C is a top view of the snorkel assembly as shown in FIG. 3A.

FIGS. 3A-3C show fluid transfer means 149 according to one preferred embodiment of this invention. Fluid transfer means 149 comprises snorkel 150 which is slidably mounted with respect to guide rod 151. Actuator means 152 is used to vertically displace snorkel 150, so that when flexible pouch 122 is at fluid transfer station 148, snorkel 150 can move downward between the upper web portions of the corresponding flexible pouch 122, and between transfer V-belts 136 at fluid transfer station 148.

Snorkel 150 preferably has an elongated configuration, as clearly shown in FIGS. 3A and 3B. Snorkel 150 also preferably has a flattened cross section so that it can sealably fit between transfer V-belts 136. According to one preferred embodiment of this invention, snorkel 150 also comprises fluid intake/exhaust means for selectively removing a first fluid, preferably air, from and injecting a second fluid, preferably a preservative in gaseous form, into each flexible pouch 122 at fluid transfer station 148. According to one preferred embodiment of this invention, fluid intake/exhaust means 153 comprise snorkel 150 having at least one passage 154. In FIGS. 3A and 3B, the location of passage 154 is identified by the dashed lead lines but passage 154 is not specifically shown in the drawings. Each passage 154 is in communication with a positive pressure supply and/or a vacuum pressure supply.

Sealing station 165 is positioned downline with respect to fluid transfer station 148. Sealing means 167 is positioned at sealing station 165 for sealing open end 123 of flexible pouch 122, at sealing station 165. Sealing means 167 also form a gas-tight seal with respect to each flexible pouch 122.

According to one preferred embodiment of this invention, sealing means 167 is positioned at sealing station 165. Only the general location of sealing station 165 is shown in FIG. 2. Although the specific technical aspects of sealing means 167 are not shown in the drawings or fully described in the specification, such sealing devices are known to those skilled in the art. However, it is an important aspect of this invention for the sealing bars or heat seal bars to contact flexible pouch 122 below the position of transfer V-belts 136, so that the gas-tight seal of flexible pouch 122 is maintained until the sealing step of the process is complete. The heat seal bars according to this invention are controlled by control means 170. The heat seal bars move relative to each other in order to contact flexible pouch 122, which is stationary until the sealing step of the process is complete.

Control means 170, as shown in FIG. 2, are used to control the feed means for feeding the continuous sheet so that corresponding flexible pouches 122 are simultaneously positioned at loading station 155, fluid transfer station 148, and sealing station 165. It is apparent that such simultaneous operation at each of the stations reduces the amount of time necessary to load, purge and heat seal each flexible pouch 122. Control means 170 also receives signals from various transducers positioned at various locations of automatic packaging apparatus 110. Such control means 170 can control many robotic functions of automatic packaging apparatus 110 and are known to those skilled in the art.

It is an important aspect of this invention for transfer V-belts 136 to be positioned on both sides of the continuous sheet and intersect a top portion of both side heat seals of each flexible pouch 122. According to one preferred embodiment of this invention, each transfer V-belt 136 is continuously routed through loading station 155, fluid transfer station 148 and sealing station 165.

Compression means are used to force together transfer V-belts 136 and thereby compress each flexible pouch 122 together and maintain the gas-tight seal, until the time that each flexible pouch 122 is conveyed from fluid transfer station 148 to sealing station 165. As shown in FIG. 2, compression means 175 comprise a plurality of pulleys which are adjustably mounted and thus can be adjusted to apply a specified force against transfer V-belts 136.

According to another preferred embodiment of this invention, automatic packaging apparatus 110 includes belt tensioning means for maintaining a belt tension of each transfer V-belt 136. As loading means 157 is operated between a separated position in which flexible pouch 122 is open and a closed position in which flexible pouch 122 is closed, transfer V-belts 136 spread from a parallel position to the open position as shown in FIG. 2, at loading station 155. Thus, a device is necessary to accommodate for the stretching distance of transfer V-belts 136 so that an approximately constant tension can be maintained.

According to one preferred embodiment of this invention, the belt tensioning means comprises at least one belt pulley 160 slidably mounted with respect to frame 111 of automatic packaging apparatus 110. Bias means 161 are used to spring load each of the slidably mounted belt pulleys 160, in order to maintain the approximately constant belt tension. It is apparent that bias means 161 can comprise a coil spring having one end fixed with respect to frame 111 and the opposite end attached with respect to the slidably mounted belt pulley 160, as shown in FIG. 2, or can comprise any other suitable configuration.

According to one preferred embodiment of this invention, flexible pouches 122, which are used with automatic packaging apparatus 110, are heat sealed along two opposing sides of each flexible pouch 122. Each heat seal 139 preferably terminates at a fixed distance from top edge 125 of each corresponding flexible pouch 122. The continuous sheet preferably has perforation 131 between each adjacent pair of flexible pouches 122, as shown in FIG. 6. As shown in FIG. 2, adjustment means 180 are used to adjust, position and maintain overlap portion 128 of each flexible pouch 122 over each corresponding transfer V-belt 136 by moving and adjusting the position of the feed means. Such arrangement is an important aspect of this invention since overlap portion 128 can sufficiently cover each transfer V-belt 136 so that contaminants, such as oil, grease, liquids and the like, do not contact transfer V-belts 136 and thus destroy the necessary frictional characteristics of each transfer V-belt 136. For example, when loading poultry into flexible pouches 122 at loading station 155, overlap portion 128 of each flexible pouch 122 is positioned over each transfer V-belt 136 and acts as a shield to protect V-belts 136 from contact with greases and other fluids which reduce the frictional characteristics of transfer V-belts 136 and cause slippage. Overlap portion 128 keeps transfer V-belts 136 clean and dry.

Adjustment means 180 has sensors which detect the position of flexible pouch 122 with respect to transfer V-belts 136. Adjustment means 180 can be calibrated to raise or lower the continuous sheet of rolled flexible pouches so that overlap portion 128 is sufficiently maintained over transfer V-belts 136.

The technical specifications of each flexible pouch 122 and the continuous sheet are a very important aspect of this invention. According to one preferred embodiment, as shown in FIG. 6, the continuous sheet preferably comprises a film of flexible material which forms a plurality of flexible pouches 122. The film is formed into two webs 124, preferably by folding the film and creating a folded edge at the bottom edge of flexible pouch 122. Each flexible pouch 122 comprises two opposing sides at which area both webs are heat sealed, as shown in FIG. 6A. Side heat seals 139 extend from a bottom portion of flexible pouch 122 and terminate at a fixed distance from top edge 125 of flexible pouch 122. With such arrangement, overlap portion 128 is formed along a top portion of flexible pouch 122. This is a very important aspect of this invention, as discussed above with respect to protecting transfer V-belts 136.

Side heat seals 139 extend all of the way to bottom edge 126 of flexible pouch 122, when the film is folded into two webs to form a folded bottom edge 126. If the bottom of flexible pouch 122 is heat sealed, then side heat seals 139 need only extend far enough to intersect with the bottom heat seal.

The continuous sheet preferably has perforations 131 extending from top edge 125 to bottom edge 126 of flexible pouch 122. Such perforations are positioned between side heat seals 139 of adjacent flexible pouches 122. According to another preferred embodiment of this invention, perforation 131 comprises upper perforated portion 132 and lower perforated portion 133, as shown in FIG. 6. So that flexible pouch 122 is most suitable to automatic packaging apparatus 110 of this invention, as shown in FIG. 2, upper perforated portion 132 has a higher tearing strength than lower perforated portion 133. In other words, it is more difficult to break or tear upper perforated portion 132 than lower perforated portion 133. It is apparent that the tearing strength of the perforation can be varied by adjusting the length of slits, as shown in FIG. 6, within the perforation or by any other means known to those skilled in the art of perforations.

According to another preferred embodiment of this invention, as shown with respect to the two far right perforations in FIG. 6, a section of perforation 131 between upper perforated portion 132 and lower perforated portion 133 is either pre-broken or forms opening 134. As discussed above with respect to film separating means 141, such design and construction of perforation 131 will allow the lower portion of the continuous sheet to separate beginning near bottom edge 126 and continue as far as the lower end of upper perforated portion 132. It is preferred to stop such separation at the lower end of upper perforated portion 132 so that overlap portion 128 of each flexible pouch 122 remains interconnected with adjacent flexible pouches 122 until the corresponding flexible pouch 122 is routed through the entire automatic packaging apparatus 110. It is apparent that the final tearing of upper perforated portion 132 can be accomplished by either mechanical or manual means.

A preferred method for automatically packaging goods begins with feeding the continuous sheet of flexible pouches 122 through the driven transfer V-belts 136. Open end 123 of each flexible pouch 122 is then separated at loading station 155. A load is inserted into each flexible pouch 122 at loading station 155. Flexible pouch 122 is then transported to fluid transfer station 148 for selectively injecting and/or withdrawing various fluids from each flexible pouch 122.

Open end 123 is then sealed at sealing station 165 to form a gas-tight seal with respect to each flexible pouch 122. The feed means is controlled to feed the continuous sheets so that corresponding flexible pouches 122 are simultaneously positioned at loading station 155, fluid transfer station 148 and sealing station 165. Transfer V-belts 136 are forced together and thereby compress each flexible pouch 122 together and maintain the gas-tight seal until each flexible pouch 122 is conveyed from fluid transfer station 148 to sealing station 165.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An automatic packaging apparatus comprising:

two driven transfer v-belts, feed means for automatically feeding a continuous sheet between said transfer v-belts, said continuous sheet forming a plurality of flexible pouches, each said flexible pouch having two adjacent overlap portions defining an open end at an upper portion of said flexible pouch;

a loading station positioned downline, with respect to a direction of travel of said continuous sheet through the automatic packaging apparatus, from said feed means, loading means for separating said adjacent overlap portions at said loading station and inserting a load into each said pouch at said loading station;

a fluid transfer station positioned downline, with respect to said direction of travel, from said loading station, fluid transfer means for injecting a first fluid into each said flexible pouch at said fluid transfer station, said fluid transfer means comprising an elongated snorkel having a flattened cross section, said snorkel positioned between said transfer belts and said adjacent overlap portions at said fluid transfer station;

a sealing station positioned downline, with respect to said direction of travel, from said fluid transfer station, sealing means for permanently sealing said open end of each said flexible pouch at said sealing station, said sealing means forming a permanent gas-tight seal with respect to each said flexible pouch;

control means for controlling said feed means to feed said continuous sheet so that a top edge of said flexible pouches is precisely positioned above and fixed with respect to said transfer belts at each of said loading station, said fluid transfer station and said sealing station; and said transverse belts positioned on both sides of said continuous sheet; each said transfer belt continuously routed through said loading station, said fluid transfer station and said sealing station; compression means for continuously forcing together said transfer belts across said fluid transfer station and said sealing station and thereby compressing opposing webs of each said flexible pouch together and maintaining a temporary gas-tight seal until each said flexible pouch is conveyed from said fluid transfer station to said sealing station and is sealed with said permanent gas-tight seal at said sealing station.

2. An automatic packaging apparatus according to claim 1 further comprising a driven conveyor belt mounted with respect to a frame of the automatic packaging apparatus for supporting said flexible pouches.

3. An automatic packaging apparatus according to claim 1 wherein said fluid transfer means further comprise: a guide rod, said snorkel slidably mounted with respect to said guide rod, actuator means for vertically displacing said snorkel, and said snorkel mounted in a position at said fluid transfer station between upper web portions of each said flexible pouch.

4. An automatic packaging apparatus according to claim 3 wherein said snorkel further comprises fluid intake/exhaust means for withdrawing a first fluid from and then injecting a second fluid into each said flexible pouch at said fluid transfer station.

5. An automatic packaging apparatus according to claim 4 wherein said fluid intake/exhaust means further comprise said snorkel having at least one passage in communication with at least one of a positive pressure supply and a vacuum pressure supply.

6. An automatic packaging apparatus according to claim 1 further comprising film separating means for separating said flexible pouches from said continuous sheet.

7. An automatic packaging apparatus according to claim 6 wherein said film separating means further comprise: a film separator bar, a breaker backup bracket having two elongated sides spaced at a distance from each other forming a breaker space, said film separator bar mateable within said breaker space, said film separator bar and said breaker backup bracket positioned on opposite sides of said continuous sheet, actuating means for displacing said film separator bar into a mated position with respect to said breaker space to separate a perforated portion of said continuous sheet, and gripping means for securing adjacent said flexible pouches with respect to each other during operation of said actuating means.

8. An automatic packaging apparatus according to claim 7 further comprising bracket means for fixing said breaker backup bracket with respect to a frame of the automatic packaging apparatus.

9. An automatic packaging apparatus according to claim 1 further comprising belt tensioning means for maintaining tension forces on said transfer belts as said loading means operates between a separated position and a closed position of said open end of each said flexible bag at said loading station.

10. An automatic packaging apparatus according to claim 9 wherein said belt tensioning means further comprise: at least one belt pulley slidably mounted with respect to a frame of the automatic packaging apparatus, and bias means for spring loading each said slidably mounted belt pulley to maintain said tension forces.

11. An automatic packaging apparatus according to claim 1 wherein each said flexible pouch is heat sealed along two opposing sides of each said flexible pouch, each said heat seal terminates at a fixed distance from a top edge of each corresponding said flexible pouch, and said continuous sheet has a perforation between each adjacent pair of said flexible pouches.

12. An automatic packaging apparatus according to claim 1 further comprising adjustment means for positioning an overlap portion of each said flexible pouch to fit over each said transfer belt, and for maintaining said overlap portion in said position as each said flexible pouch is transferred through said loading station.

13. An automatic packaging apparatus according to claim 1 wherein each said flexible pouch of said continuous sheet further comprises: a film of flexible material, said film formed into two webs, two opposing sides of one of said webs heat sealed to two corresponding opposing sides of the other of said webs forming side heat seals, each said side heat seal extending from a bottom portion of the flexible pouch and terminating at a fixed distance from a top edge of the flexible pouch thereby forming an overlap portion along a top portion of the flexible pouch.

14. An automatic packaging apparatus according to claim 13 wherein a bottom of the flexible pouch is heat sealed forming a bottom heat seal, and said bottom heat seal intersects said side heat seals of said heat sealed opposing sides.

15. An automatic packaging apparatus according to claim 13 wherein said film is folded and forms said two webs, and said side heat seals extend to a bottom edge formed by said folded film.

16. A method for automatically packaging goods comprising the steps of:

(a) automatically feeding a continuous sheet forming a plurality of flexible pouches between two driven transfer belts, with each said flexible pouch having an open end at an upper portion of said flexible pouch;

(b) separating two adjacent overlap portions at said open end of each said flexible pouch at a loading station;

(c) inserting a load into each said pouch at said loading station;

(d) positioning an elongated snorkel having a flattened cross section between said transfer belts and said adjacent overlap portions and injecting a first fluid into each said pouch, at a fluid transfer station positioned downline form said loading station;

(e) temporarily sealing said open end of each said flexible pouch by forcing together said transfer belts as each said flexible pouch is conveyed from said fluid transfer station to a sealing station which is positioned downline, with respect to a direction of travel of said continuous sheet, from said fluid transfer station;

(f) forming a permanent gas-tight seal with respect to each said flexible pouch at said sealing station;

(g) controlling said feeding of said continuous sheet so that a top edge of said flexible pouches is precisely positioned above and fixed with respect to said transfer belts as said continuous sheet is transferred from said loading station to said sealing station; and (h) continuously forcing together said transfer belt across said fluid transfer station and said sealing station and thereby compressing opposing webs of each said flexible pouch together and maintaining a temporary gas-tight seal until each said flexible pouch is conveyed from said fluid transfer station to said sealing station and is sealed with said permanent gas-tight seal at said sealing station.

* * * * *

UNITED STATES PATENT AND TRADEMARK OFFICE

CERTIFICATE OF CORRECTION

PATENT NO. : 5,187,917

DATED : February 23, 1993

INVENTOR(S) : Laurie G. Mykleby

It is certified that error appears in the above-identified patent and that said Letters Patent is hereby corrected as shown below:

Column 11, line 19, delete "v-belts" and in its place insert --belts--.

Column 11, line 21, delete "v-belts" and in its place insert --belts--.

Column 11, line 55, delete "transverse" and in its place insert --transfer--.

Column 14, line 23, delete "belt" and in its place insert --belts--.

Signed and Sealed this

Twelfth Day of July, 1994

Bruce Lehman

*Attest:*

BRUCE LEHMAN

*Attesting Officer*

*Commissioner of Patents and Trademarks*